US010176773B2

(12) United States Patent
Iwasaki et al.

(10) Patent No.: US 10,176,773 B2
(45) Date of Patent: Jan. 8, 2019

(54) SEMICONDUCTOR DEVICE AND MOBILE TERMINAL

(71) Applicant: Synaptics Japan GK, Tokyo (JP)

(72) Inventors: Yoshitaka Iwasaki, Tokyo (JP); Takashi Oyama, Tokyo (JP); Akihito Kumamoto, Tokyo (JP); Satoshi Yamaguchi, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 355 days.

(21) Appl. No.: 14/997,782

(22) Filed: Jan. 18, 2016

(65) Prior Publication Data

US 2016/0232867 A1 Aug. 11, 2016

(30) Foreign Application Priority Data

Feb. 5, 2015 (JP) ..... 2015021228

(51) Int. Cl.
*G09G 3/36* (2006.01)

(52) U.S. Cl.
CPC ..... *G09G 3/3648* (2013.01); *G09G 2330/022* (2013.01); *G09G 2330/027* (2013.01)

(58) Field of Classification Search
CPC ..... G09G 3/3677; G09G 2300/0426; G09G 2310/08; G09G 2330/04
See application file for complete search history.

(56) References Cited

U.S. PATENT DOCUMENTS 6,295,360 B1 * 9/2001 Ryan ..... H04N 5/913 348/663
6,397,230 B1 * 5/2002 Carmel ..... H04L 29/06 709/231
6,633,905 B1 * 10/2003 Anderson ..... G06F 1/26 709/219
7,538,823 B1 * 5/2009 Singh ..... H04N 9/78 348/663
8,519,940 B2 * 8/2013 Yeo ..... G09G 3/3406 345/102
9,685,129 B2 * 6/2017 Sone ..... G09G 3/3611
9,858,878 B2 * 1/2018 Sone ..... G09G 3/3611
2002/0158814 A1 * 10/2002 Bright ..... G02B 27/017 345/7
2004/0153759 A1 * 8/2004 Motegi ..... H04L 1/22 714/14
2005/0007493 A1 * 1/2005 Renner ..... H03L 7/0991 348/547
2005/0246433 A1 * 11/2005 Carrigan ..... G06F 3/023 709/223

(Continued)

*Primary Examiner* — Antonio Xavier

(74) *Attorney, Agent, or Firm* — Patterson + Sheridan, LLP

(57) ABSTRACT

A semiconductor device and a mobile terminal are described herein. In one example, a semiconductor device is provided that includes: a power-source part; an interface part; a logic part; and a driving part. In the semiconductor device, the power-source part includes a power-source-cutoff-detection circuit operable to detect a first state in which supply of an external power source is cut off. The logic part includes: a data-cutoff-detection circuit operable to detect a second state in which supply of stream data accompanied by synchronizing signals from outside the semiconductor device is cut off undesirably; and a control circuit operable to perform control for having the driving part cope with the power source cutoff with the power-source-cutoff-detection circuit detecting the first state or the data-cutoff-detection circuit detecting the second state.

18 Claims, 11 Drawing Sheets

(56) References Cited

U.S. PATENT DOCUMENTS

2006/0249580 A1* 11/2006 Nishizawa ..... G06K 7/0013 235/441
2006/0251252 A1* 11/2006 Quan ..... H04N 5/913 380/204
2006/0268172 A1* 11/2006 Chang ..... H04N 5/126 348/512
2006/0279346 A1* 12/2006 Seki ..... H03K 3/013 327/333
2007/0115360 A1* 5/2007 Biagiotti ..... H04N 11/20 348/180
2008/0106666 A1* 5/2008 Lee ..... G09G 3/3677 349/48
2008/0165109 A1* 7/2008 Joo ..... G09G 3/3677 345/98
2008/0192709 A1* 8/2008 Mikami ..... H04L 12/2854 370/338
2011/0019092 A1* 1/2011 Bridges ..... H03L 7/093 348/548
2011/0075063 A1* 3/2011 Tajiri ..... G09G 3/3651 349/42
2011/0122877 A1* 5/2011 Gelke ..... H04N 21/226 370/400
2011/0199397 A1 8/2011 Ko et al.
2013/0038597 A1* 2/2013 Kim ..... G09G 3/3688 345/213
2014/0002438 A1 1/2014 Higashi et al.
2014/0176524 A1* 6/2014 Lee ..... G09G 3/3233 345/212
2014/0298065 A1* 10/2014 Sakamaki ..... G06F 1/1626 713/323
2016/0127614 A1* 5/2016 Molnar ..... H04N 5/04 386/207

* cited by examiner

SEMICONDUCTOR DEVICE AND MOBILE TERMINAL

CROSS-REFERENCE TO RELATED APPLICATIONS

The present application claims priority from Japanese application JP 2015-021228 filed on Feb. 5, 2015, the content of which is hereby incorporated by reference into this application.

BACKGROUND

The present invention relates to a control technique for taking a measure against an undesired power source cutoff in a semiconductor device or a mobile terminal, which is useful in application to e.g., a liquid crystal display driver.

In the event of cutoff of an action power source of a driving type semiconductor device such as a liquid crystal driver, it is necessary to initialize or stabilize the driving state of the semiconductor device directed toward the outside. For instance, a liquid crystal display driver executes a response process for coping with the cutoff of an action power source by causing pixels of a liquid crystal panel to release their own electric charges forming information, or comparable means; and the response process is intended to avoid undesired charges remaining on the pixels of the liquid crystal panel after the power source cutoff and leaving a residual image or a display speckle on the panel. As the requirement for starting the response process, the detection of a voltage reduction of a driving power source (VDD2) for driving a liquid crystal panel as described in e.g., the Japanese Unexamined Patent Application Publication No. JP-A-2011-170349 may be used. The process in response to the power source cutoff like that is controlled by a logic circuit working on a so-called logic voltage lower than a drive voltage. Further, in JP-A-2014-010231, an attempt to start the response process on detection of a voltage reduction of a logic power source is made in consideration of the fact that even if the attempt to start the response process is made based on a voltage reduction of a driving power source, the response process cannot be completed owing to the lowering of the logic power source in the middle of or before the voltage reduction of the driving power source. Still further, in JP-A-2014-202792, an attempt to start the response process is made in any of the event of a voltage reduction of the driving power source and the event of a voltage reduction of a logic power source. The means disclosed by JP-A-2014-202792 is arranged so that in the response process started owing to a voltage reduction of the logic power source, the voltage of the driving power source is lowered and used for the action power source of the logic circuit.

As described above, the patent documents JP-A-2011-170349, JP-A-2014-010231 and JP-A-2014-202792 have been considered prior to the invention hereof.

SUMMARY

A semiconductor device and a mobile terminal are described herein. In one example, a semiconductor device includes a power-source part, an interface part, a logic part, and a driving part. The power-source part is operable to produce internal power sources on accepting input of external power sources. The interface part is operable to accept input of stream data accompanied by synchronizing signals from the outside. The logic part is operable to process stream data input to the interface part. The driving part is operable to output drive signals to the outside based on the process of the stream data by the logic part. The power-source part includes a power-source-cutoff-detection circuit that is operable to detect a first state in which supply of the external power source is cut off. The logic part includes a data-cutoff-detection circuit that is operable to detect a second state in which supply of stream data accompanied by synchronizing signals from outside the semiconductor device is cut off undesirably. The control circuit is operable to perform control for having the driving part cope with the power source cutoff with the power-source-cutoff-detection circuit detecting the first state or the data-cutoff-detection circuit detecting the second state.

In another example, a mobile terminal is provided that includes a host device, a driving device, a driven device, a battery power-source part, an interface part, a logic part, and a control circuit. The driving device is operably controlled by the host device. The driven device is operably driven by the driving device. The driving device has a power-source part that is operable to produce internal power sources on accepting input of external power sources from the battery power-source part. The interface part is operable to accept input of stream data accompanied by synchronizing signals from the host device. The logic part is operable to process stream data input to the interface part. The driving part is operable to output drive signals to the outside based on the process of the stream data by the logic part. The power-source part includes a power-source-cutoff-detection circuit that is operable to detect a first state in which supply of the external power source is cutoff. The logic part includes a data-cutoff-detection circuit that is operable to detect a second state in which supply of stream data accompanied by synchronizing signals from the host device is cut off undesirably. The control circuit is operable to perform control for having the driving part cope with the power source cutoff with the power-source-cutoff-detection circuit detecting the first state or the data-cutoff-detection circuit detecting the second state.

BRIEF DESCRIPTION OF THE DRAWINGS

FIG. 3 is an explanatory diagram of the display driver which a first embodiment of the control for having a driving part cope with power source cutoff is adopted for;

FIG. 4 is an explanatory diagram of the display driver which a second embodiment of the control for having the driving part cope with power source cutoff is adopted for;

FIG. 11 is a block diagram showing an embodiment of a mobile terminal which the semiconductor device of FIG. 3 or 4 having a touch panel controller incorporated therein together with a display driver is adopted for.

DETAILED DESCRIPTION

Figure 1:
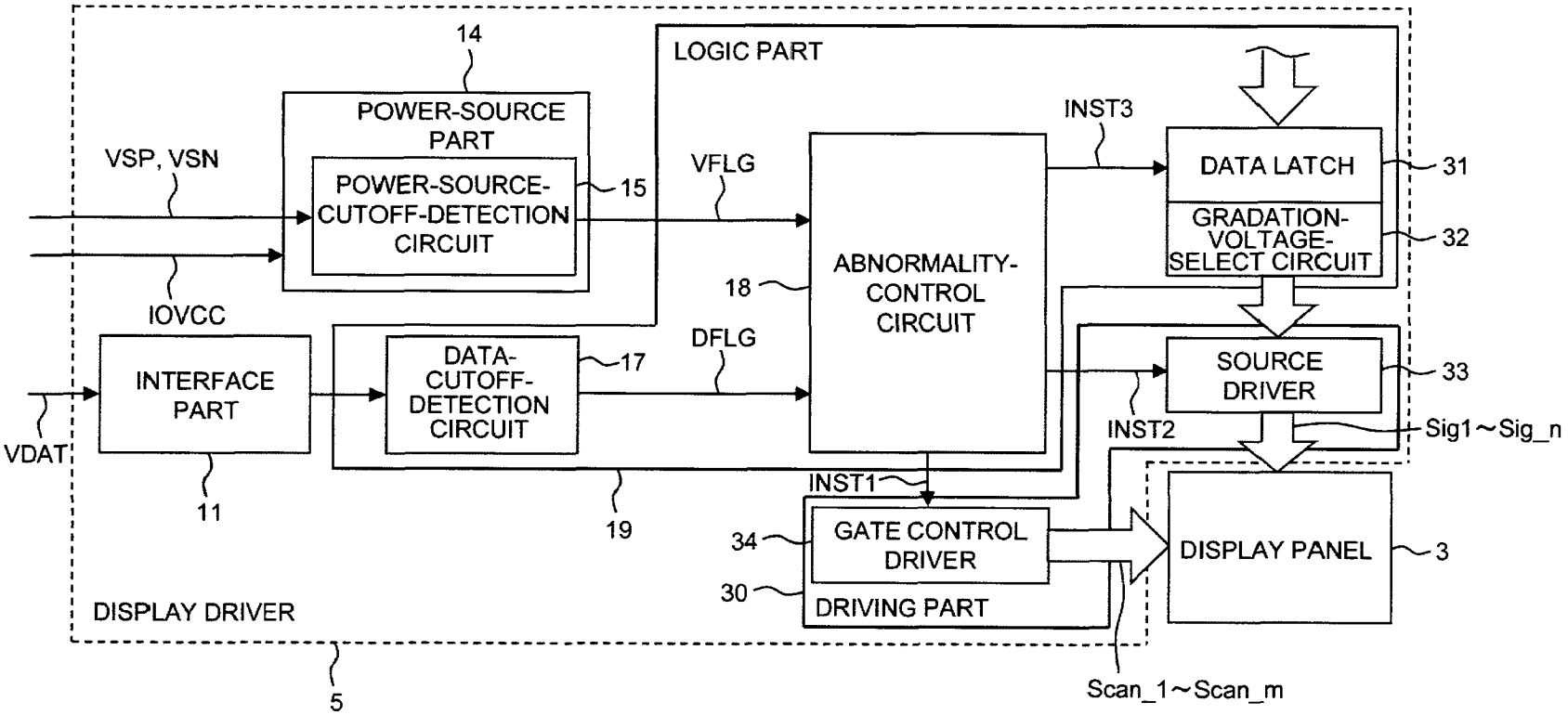
FIG. 1 is a block diagram showing, by example, a display driver as an embodiment of the semiconductor device according to the invention.

The inventor has made a study on detection techniques for starting a response process in response to cutoff of a power source. According to such detection techniques, the response process is started on detection of a voltage reduction of an external power source conventionally. In such a case, even if the response process is started by the voltage reduction of a driving power source as in JP-A-2011-170349, the power source of a logic circuit having control of the response process is not always maintained. For instance, in a system such as a battery-driven mobile terminal, in case that the battery is taken off, the voltage of the logic power source undesirably drops together with the driving power source, resulting in the power source cutoff. In this case, a measure to externally provide a capacitive element for power source stabilization can be taken for the purpose of easing the drop in the logic power source, but taking such measure ends up resulting in the increase in circuit elements, the upsizing of the circuit, and the increase in the number of assembling steps . The same holds true in regard to the technique disclosed in JP-A-2014-010231. In the case of JP-A-2014-202792, it is not necessarily assured that the driving power source be maintained at a desired voltage; a capacitive element for the stabilization needs to be externally provided as well, and it becomes necessary to add a circuit such as a regulator for lowering the driving power source, thereby allowing the driving power source to be used as a power source of the logic circuit.

It is benefit of the invention to provide a semiconductor device capable of coping with an undesired power source cutoff readily without fail. Further, it is another benefit of the invention to provide a mobile terminal to which such a semiconductor device is applied.

The above and other benefits of the invention and novel features thereof will become apparent from the description hereof and the accompanying diagrams.

Of the embodiments herein disclosed, a representative embodiment will be briefly outlined below. The reference numerals and others for reference to the diagrams here, which are noted in pairs of round brackets, are just examples for easier understanding.

<Logical Detection of Power Source Cutoff Based on Abnormality of a Condition of Interface with the Outside>

The inventor turned to not only the actual detection of a voltage reduction of an external power source, but also the logical detection of power source cutoff on the higher-position device side of a system based on abnormality of a condition of interface with the outside.

A semiconductor device (1, 5) according to one example includes: a power-source part (14) operable to produce an internal power source on accepting input of an external power source; an interface part (11) operable to accept input of stream data accompanied by synchronizing signals from the outside; a logic part (19) operable to process stream data input to the interface part; and a driving part (30) operable to output drive signals to the outside based on the process of the stream data by the logic part. The power-source part includes a power-source-cutoff-detection circuit (15) operable to detect a first state (power source cutoff) in which supply of the external power source is cut off . The logic part includes: a data-cutoff-detection circuit (17) operable to detect a second state (data cutoff) in which supply of stream data accompanied by synchronizing signals from outside the semiconductor device is cut off undesirably; and a control circuit (18) operable to perform control for having the driving part cope with the power source cutoff with the power-source-cutoff-detection circuit detecting the first state or the data-cutoff-detection circuit detecting the second state.

According to the embodiment like this, it is possible to cope with the power source cutoff based on detection of undesired data cutoff of stream data from the outside. That is, not only actually detecting the reduction in voltage of the external power source, but also logically detecting, based on the abnormality, i.e., data cutoff, in the condition of interface with the outside part, the power source cutoff on the higher-position device side of the system, the detection of power source cutoff can be stepped up. This enables the contribution to the system downsizing and the decrease in the burden imposed on users including manufacturers of assembled products without need for increasing or enlarging an external capacitive element for power source system stabilization.

Data Cutoff Detection Based on the Presence or Absence of Synchronizing Signals

In the semiconductor device described above, the data-cutoff-detection circuit detects the second state based on e.g., the presence or absence of synchronizing signals accompanying the stream data.

According to the embodiment like this, the abnormality in synchronous data supply from a device on a higher position side of the system to the semiconductor device owing to power source cutoff can be relatively easily determined by focusing on synchronizing signals. This is based on the following premise: on condition that power source cutoff is caused on a system owing to the fall of a battery mounted in a battery power source, the reduction in battery voltage, etc. for example, an abnormality arises in the device on the higher position side of the system earlier than the semiconductor device, or the abnormality in an external interface action arises earlier than the abnormality developed in logic operation in the semiconductor device.

Detection of Undesired Data Cutoff by the Data-Cutoff-Detection Circuit

In the semiconductor device described above, the data-cutoff-detection circuit has e.g., a counter (51) operable to count clock signals and arranged so that its count value is initialized by the synchronizing signals, a comparator (54) operable to compare the count value of the counter with a threshold, and a register (52) on which the threshold is set overwritably; and on condition that an interface mode to input stream data accompanied by the synchronizing signals is set, the data-cutoff-detection circuit detects, as the second state, the event of the count value of the counter exceeding the threshold.

According to the embodiment like this, the data-cutoff-detection circuit can be arranged relatively readily.

Display Driver

In the semiconductor device described above, the logic part accepts input of display data and processes the display data. The driving part outputs drive signals to the outside to drive a display panel. The stream data accompanied by the synchronizing signals are display data accompanied by display timing signals as the synchronizing signals, and supplied like streams.

According to the embodiment like this, the semiconductor device functions as a display driver, and enables the elimination of the risk that drive signals irregularly remain on a display panel owing to an undesired power source cutoff, consequently worsening the characteristics of the display panel.

Data Cutoff Detection Based on the Presence or Absence of Display Timing Signal

Even in the case of the semiconductor device serving as a display driver, it may be arranged so that the data-cutoff-detection circuit detects the second state based on the presence or absence of a predetermined display timing signal of the display timing signals. For instance, the predetermined display timing signal may be a horizontal synchronizing signal or a vertical synchronizing signal.

Detection of Undesired Data Cutoff by the Data-cutoff-detection Circuit

Even in the case of the semiconductor device serving as a display driver, it maybe arranged as described above so that the data-cutoff-detection circuit has a counter operable to count clock signals, of which the count value is initialized by the predetermined display timing signal, a comparator operable to compare the count value of the counter with a threshold, and a threshold register on which the threshold is set overwritably, and on condition that an interface mode to input stream data accompanied by the display timing signals is set, the data-cutoff-detection circuit may detect, as the data cutoff, the event of the count value of the counter exceeding the threshold.

Instruction for Coping with Power Source Cutoff

In the semiconductor device described above, the control for having the driving part cope with power source cutoff is e.g., control for the driving part to initialize charge information remaining on pixels of the display panel, or control for the driving part and the logic part to uniform pixels of the display panel in charge information.

According to the embodiment like this, a semiconductor device functioning as a display driver can be readily achieved, which is arranged to be able to avoid such an event that drive signals of a display panel irregularly remain on the display panel owing to undesired power source cutoff.

External Power Source and Internal Power Source

In the semiconductor device described above, e.g., the external power sources are composed of first external power sources (VSP, VSN) and a second external power source (IOVCC) lower than the first external power sources in voltage absolute value; the internal power sources are composed of first internal power sources produced from the first external power sources and a second internal power source produced from the second external power source; the power-source-cutoff-detection circuit detects the power source cutoff concerning the first external power sources; the interface part and the logic part each utilize the second internal power source as an action power source; and the driving part utilizes the first internal power source as an action power source.

Mobile Terminal Operable to Logically Detect Power Source Cutoff Based on Abnormality in Condition of Interface with the Outside A mobile terminal (PDA) according to one example has: a host device (2); a driving device (1, 5) controlled by the host device; a driven device (3) driven by the driving device; and a battery power-source part (120). The driving device has a power-source part operable to produce internal power sources on accepting input of external power sources from the battery power-source part, an interface part operable to accept input of stream data accompanied by synchronizing signals from the host device, a logic part operable to process stream data input to the interface part, and a driving part operable to output drive signals to the outside based on the process of the stream data by the logic part. The power-source part includes a power-source-cutoff-detection circuit operable to detect a first state (power source cutoff) in which supply of the external power source is cut off. The logic part includes a data-cutoff-detection circuit operable to detect a second state (data cutoff) in which supply of stream data accompanied by synchronizing signals from the host device is cut off undesirably, and a control circuit operable to perform control for having the driving part cope with the power source cutoff with the power-source-cutoff-detection circuit detecting the first state or the data-cutoff-detection circuit detecting the second state.

According to the embodiment like this, it is possible to cope with the power source cutoff based on detection of undesired data cutoff of stream data from the host device. That is, the driving device is arranged so as to not only actually detect the reduction in voltage of the external power source owing to the battery fall in the battery power-source part, the reduction in battery voltage or the like, but also logically detect the power source cutoff of the mobile terminal based on the abnormality in the condition of interface with the outside, i.e., data cutoff in the condition of interface with the outside part and thus, the detection of power source cutoff can be stepped up. This enables the contribution to the mobile terminal downsizing and the decrease in the burden imposed on users including manufacturers of assembled products without the need for increasing or enlarging an external capacitive element for power source system stabilization.

Display Driver

In the mobile terminal, e.g., the logic part accepts input of display data and processes the display data; the driving part outputs drive signals to the outside to drive a display panel which is the driven device; and the stream data accompanied by the synchronizing signals are display data accompanied by display timing signals as the synchronizing signals, and supplied like streams.

According to the embodiment like this, the driving device functions as a display driver operable to drive a display panel, and enables the elimination of the risk that drive signals irregularly remain on a display panel owing to an undesired power source cutoff, consequently worsening the characteristics of the display panel.

Detection of Data Cutoff Based on the Presence or Absence of a Horizontal Synchronizing Signal In the case of the driving device serving as a display driver, e.g., the data-cutoff-detection circuit detects the second state based on the presence or absence of a horizontal synchronizing signal of the display timing signals, or the data-cutoff-detection circuit detects the second state based on the presence or absence of a vertical synchronizing signal of the display timing signals. This is based on the following premise: on condition that power source cutoff is caused on a mobile terminal owing to e.g., the fall of a battery mounted in a battery power-source part, the reduction in battery voltage, etc. the host device of the terminal device becomes abnormal earlier than the driving device, or the abnormality in an external interface action arises earlier than abnormality developed in logic operation in the driving device.

Detection of an Undesired Data Cutoff by the Data-cutoff-detection Circuit

In the case of the driving device serving as a display driver, the data-cutoff-detection circuit has e.g., a counter operable to count clock signals and arranged so that its count value is initialized by the horizontal synchronizing signal (or vertical synchronizing signal), a comparator operable to compare the count value of the counter with a threshold, and a threshold register on which the threshold is set overwritably. On condition that an interface mode to input stream data accompanied by the display timing signals is set, the data-cutoff-detection circuit detects, as the second state, the event of the count value of the counter exceeding the threshold.

Instruction for Coping with Power Source Cutoff

In the case of the driving device serving as a display driver, the control for having the driving part cope with power source cutoff is e.g., control for the driving part to initialize charge information remaining on pixels of the display panel, or control for the driving part and the logic part to uniform pixels of the display panel in charge information.

According to the embodiment like this, the driving device serving as a display driver can be readily achieved, which is arranged to be able to avoid such an event that drive signals of a display panel irregularly remain on the display panel owing to undesired power source cutoff.

The effect achieved by the representative embodiment herein disclosed will be briefly described below.

Not only actually detect the reduction in voltage of the external power source, but also logically detect the power source cutoff based on the abnormality in the condition of interface with the outside on the higher-position device side of the system is enabled and thus, the detection of power source cutoff can be stepped up. Further, the invention enables the contribution to the system downsizing and the decrease in the burden imposed on users including manufacturers of assembled products without the need for increasing or enlarging an external capacitive element for power source system stabilization.

FIG. 1 shows, by example, a display driver as an embodiment of the semiconductor device according to the invention. Although no special restriction is intended, a display driver 5 shown in the diagram is formed on a substrate of a semiconductor such as monocrystalline silicon together with other appropriate circuit blocks on an as-needed basis by CMOS integrated circuit manufacturing technique.

The structure of the display driver 5 shown, by example, in FIG. 1 is arranged focusing on a characteristic structure for preventing an undesired power source cutoff from adversely affecting a display panel 3. Therefore, the graphical representation of the general structure of the display driver 5 is omitted in the diagrams.

Figure 2:
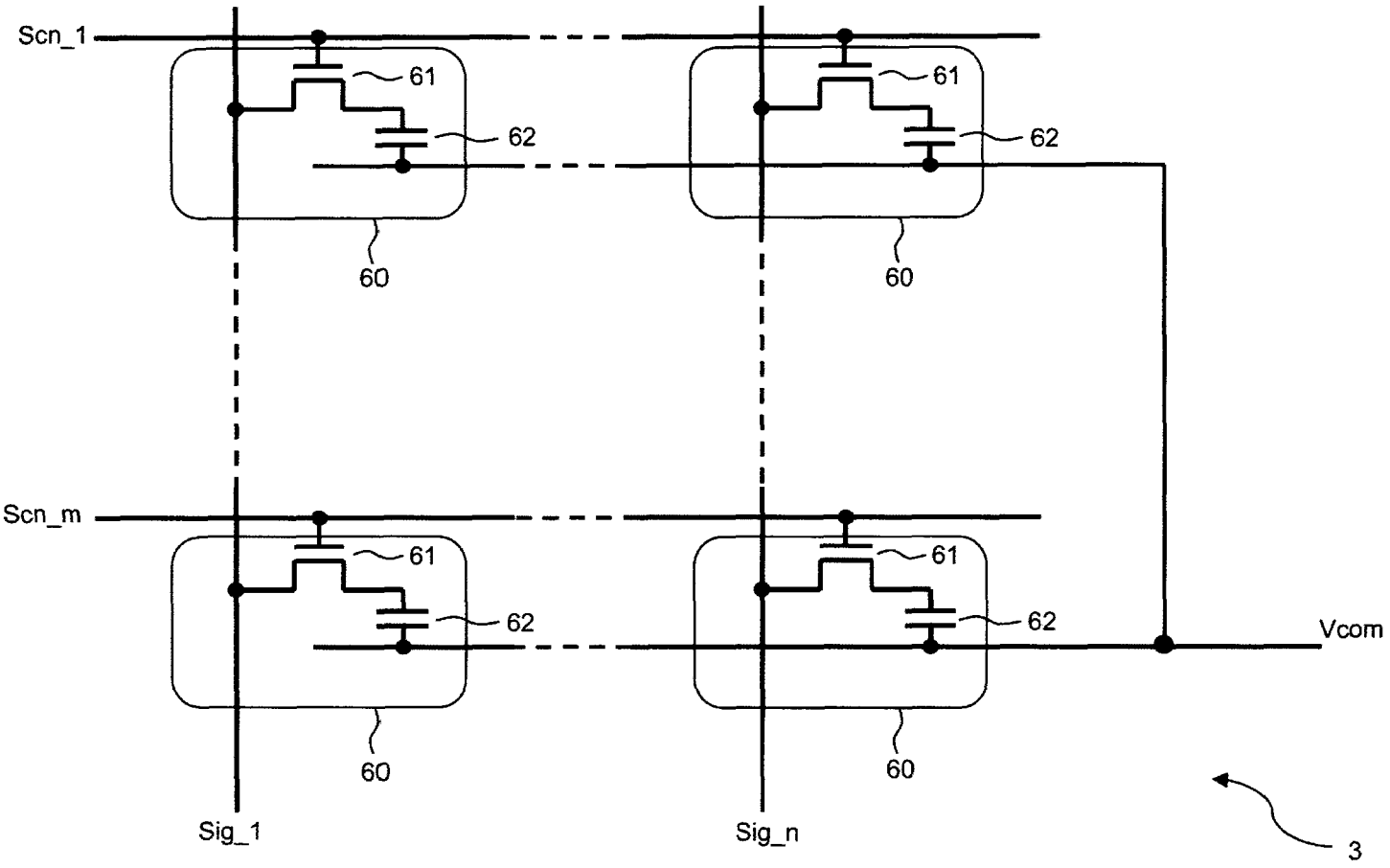
FIG. 2 is a circuit diagram showing, by example, the schematic circuit structure of a display panel.

Although no special restriction is intended, it is presupposed as to the embodiment of FIG. 1 that the display panel 3 is a liquid crystal display panel. As shown in FIG. 2 by example, the display panel 3 has pixels 60 arranged on a glass substrate like a matrix; and each pixel 60 has a thin-film transistor 61 and a liquid crystal element 62 which are connected in series. The liquid crystal elements 62 of the pixels are provided with a common potential Vcom. The thin-film transistors 61 have select terminals connected with corresponding scan electrodes Scn_1 to Scn_m for each X-direction, and signal terminals connected with corresponding signal electrodes Sig_1 to Sig_n for each Y-direction. Lines of the pixels of the scan electrodes Scn_1 to Scn_m form display lines respectively. The display lines are selected by turning on the thin-film transistors 61 of the pixels 60 in units of the display lines (display line scan). Gradation voltages are applied to the liquid crystal elements 62 from the signal electrodes Sig_1 to Sig_n in each select period (horizontal display period) of the display lines. Turning off the thin-film transistors 61, capacitance components of the liquid crystal elements hold the gradation voltages applied thereto to keep a shutter condition of the liquid crystal until the corresponding display lines are selected next time. In a normal power source cutoff by a power switch or the like, a shutdown sequence for causing all the pixels to discharge charges is performed before the power source reaches an operation-assurance voltage or below. For instance, all the display lines are selected and in parallel, the ground potential is put on all the signal electrodes and provided for the common potential Vcom. In case of undesired cutoff of the power source, the operation-assurance voltage may not be maintained until the completion of the shutdown sequence. In such a case, some abnormality will be caused in selection of the display lines and the selections of the gradation voltages and consequently, information originating from undesired charges will remain on the pixels, producing display speckles and resulting in the deterioration of characteristics of the pixels 60. FIG. 1 shows, by example, a characteristic structure for taking a measure against such an undesired power source cutoff.

Referring to FIG. 1, the display driver 5 has: a power-source (circuit) part 14 which accepts input of external power sources VSP, VSN, IOVCC and produces an internal power source; an interface (circuit) part 11 which accepts input of streams of display data VDAT accompanied by display timing signals such as vertical and horizontal synchronizing signals as synchronizing signals from outside; a logic (circuit) part 19 which processes the display data VDAT input to the interface part 11; and a driving (circuit) part 30 which outputs drive signals to the scan electrodes Scn_1 to Scn_m and the signal electrodes Sig_1 to Sig_n based on the processing of the display data VDAT by the logic part 19. The power-source part 14 includes e.g., a power-source-cutoff-detection circuit 15 for detecting a first state (power source cutoff) in which supply of the external power source VSP is cut off. Although no special restriction is intended, the power-source-cutoff-detection circuit 15 compares, by use of a comparator, a partial voltage of the external power source VSP, resulting from voltage division by resistance, with a predetermined reference potential. Detecting the external power source VSP equal to or lower than a predetermined voltage, the power-source-cutoff-detection circuit determines the first state (power source cutoff) to be created concerning the external power source VSP. As described above, the power source cutoff cited here does not imply the state of being incapable of retaining the operation-assurance voltage. Detecting the first state, the power-source-cutoff-detection circuit 15 brings a power-source-cutoff-detection flag VFLG into the state of being set. The logic part 19 has a data-cutoff-detection circuit 17 for detecting a second state (data cutoff) in which supply of stream data VDAT accompanied by synchronizing signals from outside the display driver 5 is undesirably cut off. Detecting the second state, the data-cutoff-detection circuit 17 brings a data-cutoff-detection flag DFLG into the state of being set. The logic part 19 includes a control circuit (hereinafter referred to as "abnormality-control circuit" simply) 18 which performs control for having the driving part 30 cope with the power source cutoff on condition that any one of the power-source-cutoff-detection flag VFLG and the data-cutoff-detection flag DFLG is brought into the state of being set. The process according to the control for having the driving part 30 cope with the power source cutoff is also referred to as "abnormal power-off sequence" below.

According to the embodiment shown in FIG. 1, the driving part 30 has: a gate-control driver 34 for outputting display line select signals to the scan electrodes Scn_1 to Scn_m; and a source driver 33 for outputting gradation drive signals of the pixels to the signal electrodes Sig_1 to Sig_n. The source driver 33 outputs gradation drive signals according to select data which the gradation-voltage-select circuit 32 selects based on line display data latched by the data latch circuit 31 in display lines.

The control for having the driving part 30 cope with the power source cutoff is applied to e.g., the gate-control driver 34, the source driver 33, and the data latch circuit 31. In a first embodiment of the control for having the driving part cope with the power source cutoff, the abnormality-control circuit controls, by a control signal INST1, the gate-control driver 34 to select all the scan electrodes Scn_1 to Scn_m (all the display lines), and controls, by a control signal INST2, the source driver 33 to supply the ground potential to all the signal electrodes Sig_1 to Sig_n and for the common potential Vcom. Thus, charges of all the pixels 60 of the display panel 3, which make information, are discharged. In a second embodiment of the control for having the driving part cope with the power source cutoff, the abnormality-control circuit controls, by the control signal INST1, the gate-control driver 34 to select all the scan electrodes Scn_1 to Scn_m (all the display lines), and controls, by a control signal INST3, the data latch circuit 31 to latch black data or the gradation-voltage-select circuit 32 to select a black gradation voltage. Thus, all the pixels 60 of the display panel 3 display black data representing the state of being generally discharged.

Figure 3:
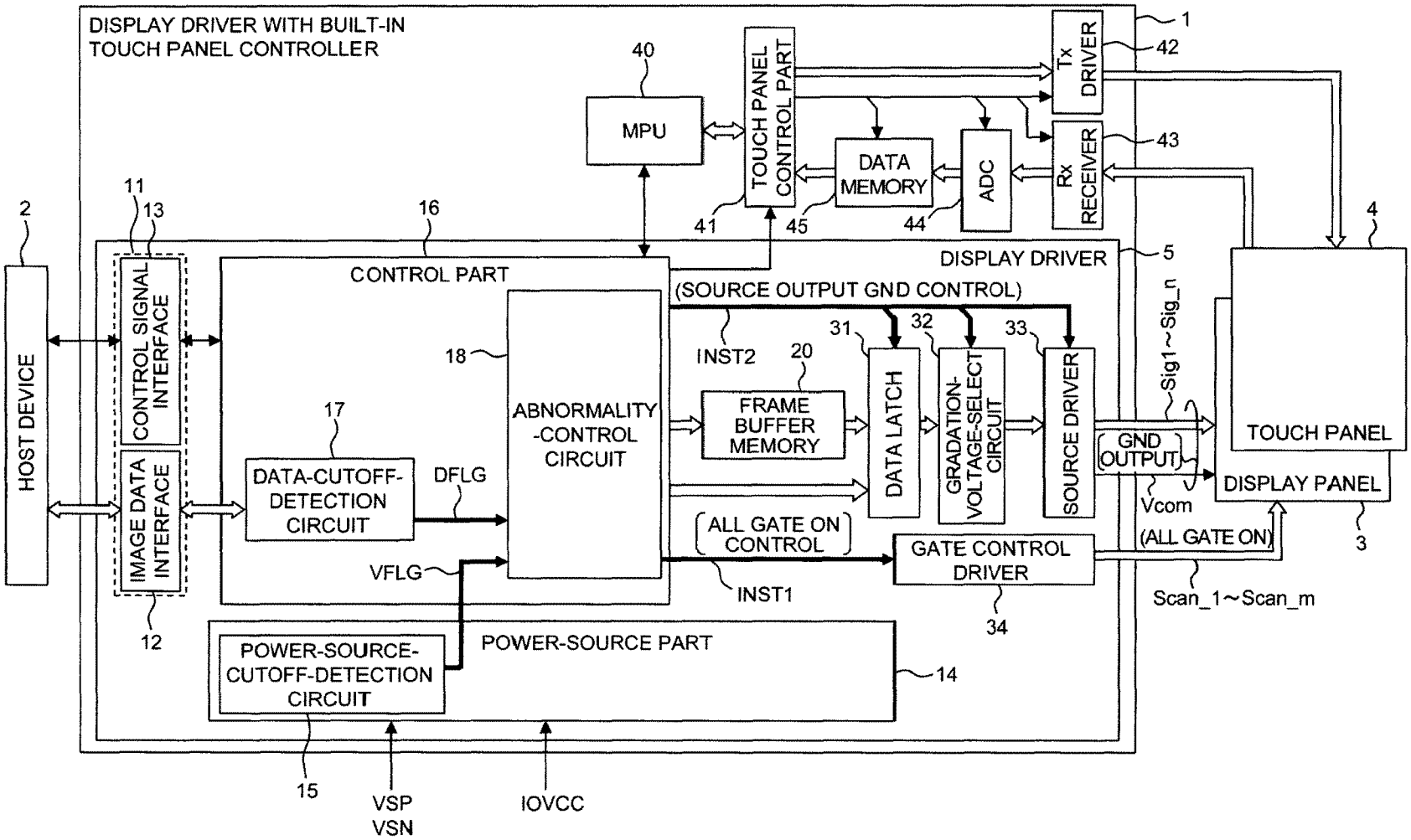
Figure 4:
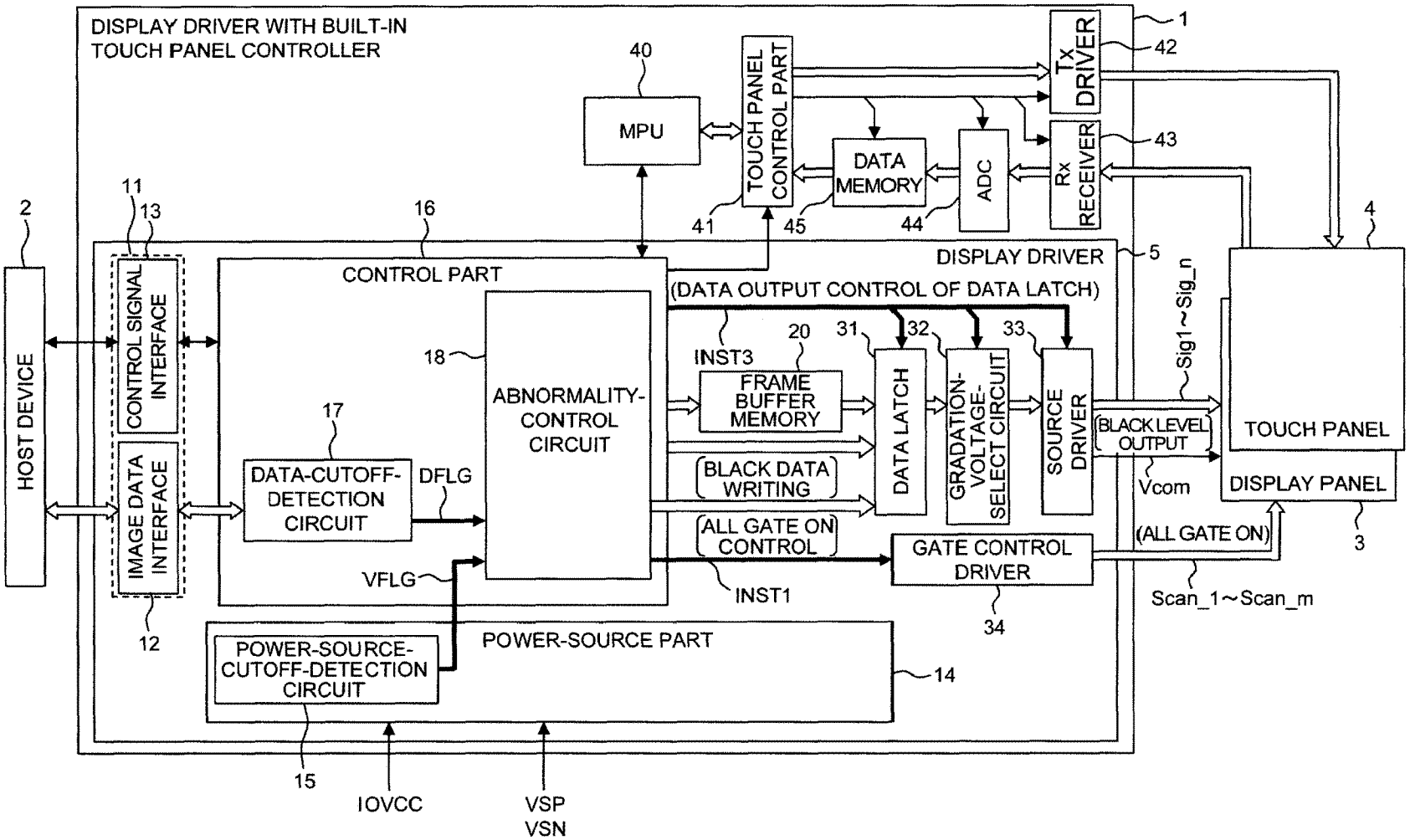

FIG. 3 shows, by example, the details of the display driver 5 for which the first embodiment of the control is adopted. FIG. 4 shows, by example, the details of the display driver 5 for which the second embodiment of the control is adopted. Although no special restriction is intended, FIGS. 3 and 4 each show an embodiment of a semiconductor device 1 having a touch panel controller built in a semiconductor substrate of the display driver 5.

In the embodiments of FIGS. 3 and 4, the interface part 11 connected with a host device 2 has an image data interface 12 and a control signal interface 13. Although no special restriction is intended, the image data interface 12 has: an action mode (also referred to as "video mode" simply) compliant with MIPI (Mobile Industry Processor Interface)-DSI(Display Serial Interface) video mode to input display data in synchronization with a display timing; and an action mode (also referred to as "command mode" simply) compliant with MIPI command mode as a second interface mode to input display data in asynchronization with display timing. The setting on whether to specify the command mode or the video mode is made on a mode register 53 through the control signal interface 13 from outside. Although no special restriction is intended, the control signal interface 13 is assigned for input and output of control data and control commands, and is compliant with MIPI or MDDI (Mobile Display Digital Interface), or the like. According to this embodiment, the data-cutoff-detection circuit 17 makes judgment on the cutoff of display data VDAT input in the video mode based on the presence or absence of the display timing signal. The method for the judgment is to be described later.

Display data input in the video mode are defined, in display frame, by vertical synchronizing signals input together therewith; and its horizontal synchronization period is defined by horizontal synchronizing signals input together with the display data. As to display data input in the video mode, a control (circuit) part 16 recognizes a display frame and a horizontal synchronization period according to vertical and horizontal synchronizing signals input together therewith and concurrently, latches the display data in display lines by the data latch circuit 31. The gradation-voltage-select circuit 32 produces gradation-select data from the data latched in display lines. The source driver 33 receives the gradation-select data and drives the signal electrodes Sig_1 to Sig_n. The gate-control driver 34 sequentially selects the scan electrodes Scn_1 to Scn_m in each horizontal synchronization period in units thereof.

Display data input in the command mode are once stored in a frame buffer memory 20. The stored display data are read out and put in the data latch circuit 31 in display lines in each horizontal synchronization period according to horizontal synchronizing signals produced in the control part 16. The gradation-voltage-select circuit 32 produces gradation-select data by the data thus latched in display lines. The source driver 33 receives the gradation-select data and drives the signal electrodes Sig_1 to Sig_n. The gate-control driver 34 sequentially selects the scan electrodes Scn_1 to Scn_m in display lines in each horizontal synchronization period. Now, it is noted that the control part 16, the frame buffer memory 20, the data latch circuit 31 and the gradation-voltage-select circuit 32 shown in FIGS. 3 and 4 are circuits included in the logic part 19 shown in FIG. 1.

The touch panel controller includes: a microcomputer (MPU) 40; a touch panel control (circuit) part 41; a Tx driver 42; an Rx receiver 43; an analog-to-digital conversion circuit (ADC) 44; and a data memory 45. The touch panel controller performs a touch-sensing action with a touch panel 4. The touch panel 4 has: drive electrodes which are sequentially scan-driven by the Tx driver; and detection electrodes disposed to cross the drive electrodes; a predetermined capacitance component is formed at each cross point of the electrodes. With the Tx driver 42 driving the drive electrodes, the touch panel controller integrates, by the Rx receiver, an electric charge developed on the detection electrode according to the difference in electrostatic capacitance depending on the presence or absence of an subject (e.g. , a finger) at or near each cross point, integrates, by ADC 44, the charge thus integrated into digital touch signals, and accumulates the digital touch signals in the data memory 45. MPU 40 reads out digital touch signals for a whole plane of the touch panel 4 from the data memory 45, and acquires touch coordinates based on the distribution of the digital touch signals.

The power-source part 14 accepts the input of analog external power sources (first external power sources) VSP, VSN, and the input of an external power source (second external power source) IOVCC for logic which is lower than in voltage absolute value. These external power sources are supplied from a battery power-source part in the case of a mobile terminal. For instance, they are given as follows: VSP=+5.4V; VSN=−5.4V; and IOVCC=1.8. The power-source part 14 produces first internal power sources to be used for gradation voltages, gate drive voltages and others based on the external power sources (first external power sources) VSP, VSN, and supplies them to the source driver 33, the gate-control driver 34, etc. In addition, the power-source part supplies the interface part 11 with a second internal power source, e.g., 1.8V for host interface based on the external power source (second external power source) IOVCC, and supplies a second internal power source, e.g., 1.3V for internal logic to the control part 16, the frame buffer memory 20, the data latch circuit 31, and the gradation-voltage-select circuit 32. Incidentally, MPU 40, the touch panel control part 41, the data memory 45, ADC 44, etc. are supplied with an internal power source for internal logic, e.g., 1.3V, which is produced based on the external power source (second external power source) IOVCC, whereas the Tx driver 42, the Rx receiver 43, etc., are supplied with an internal power source produced based on the external power sources (first external power sources) VSP.

In the display driver of FIG. 3, for which the first embodiment of the control for having the driving part 30 cope with the power source cutoff is adopted, the gate-control driver 34 selects all the scan electrodes Scn_1 to Scn_m (all the display lines) according to the control signal INST1. In order to supply the ground potential to all the signal electrodes Sig_1 to Sig_n by providing the control signal INST2 to only the source driver 33, the display driver may be arranged so that a switch circuit to selectively enable the direct connection of the final output stage of the source driver 33 to the ground is controlled, in switching, by the control signal INST2. Further, in order to supply the ground potential to all the signal electrodes Sig_1 to Sig_n by providing the control signal INST2 to only the gradation-voltage-select circuit 32, the display driver may be arranged so that a switch circuit to selectively enable the direct connection of the final output stage of the gradation-voltage-select circuit 32 to a ground select level is controlled, in switching, by the control signal INST2. In addition, in order to supply the ground potential to all the signal electrodes Sig_1 to Sig_n by providing the control signal INST2 to only the data latch circuit 31, the display driver may be arranged so that a switch circuit to selectively enable the direct connection of the input of each bit of the data latch circuit 31 to a ground-select value is controlled, in switching, by the control signal INST2. In order to provide the ground potential for common potential Vcom, the display driver may be arranged so that the source driver 33 receives the control signal INST2, and a switch circuit to selectively provide the ground potential for the common potential Vcom is controlled, in switching, by the control signal INST2.

Figure 5:
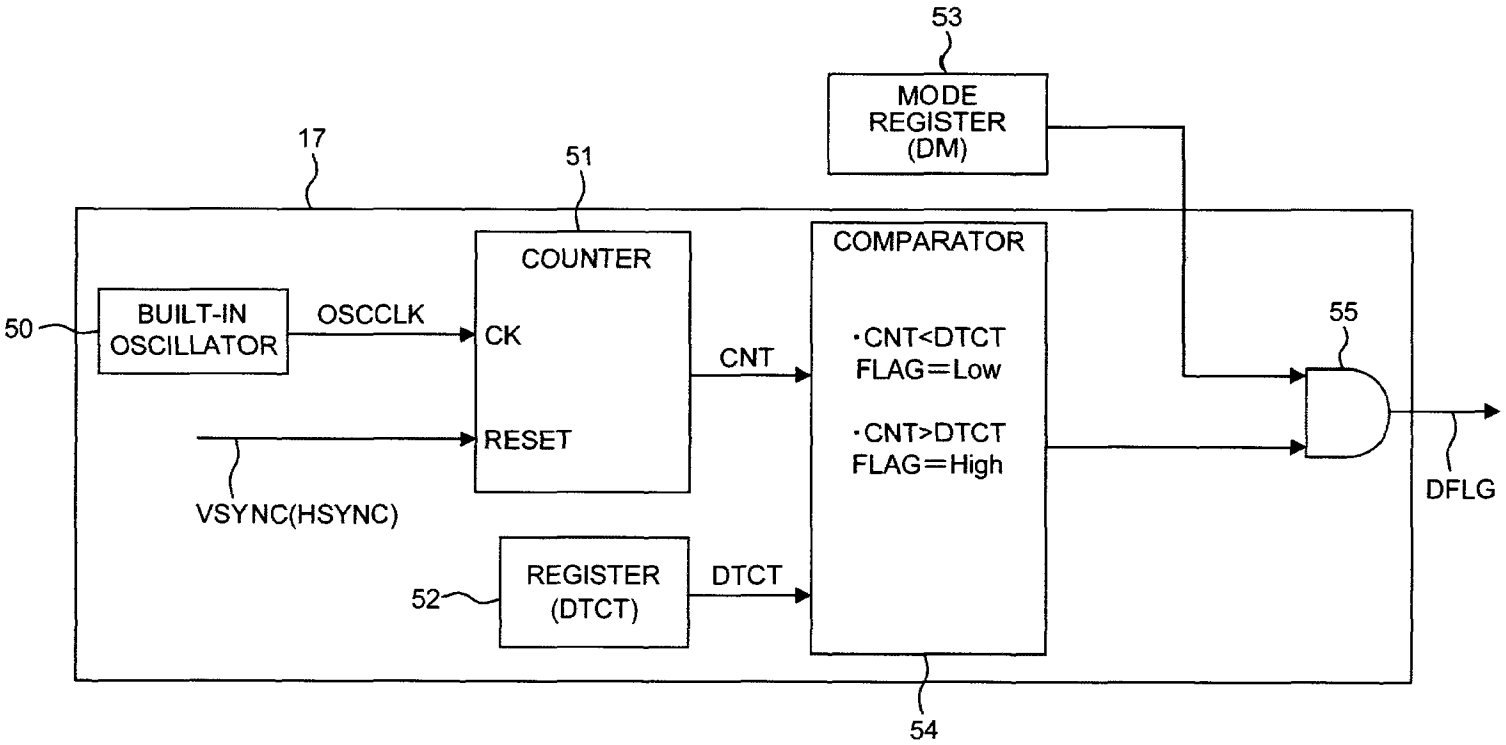
FIG. 5 is a block diagram showing an example of a data-cutoff-detection circuit.

In the display driver of FIG. 4, for which the second embodiment of the control for having the driving part 30 cope with the power source cutoff is adopted, the gate-control driver 34 selects all the scan electrodes Scn_1 to Scn_m (all the display lines) by the control signal INST1. In order to supply a black-display potential to all the signal electrodes Sig_1 to Sig_n by providing the control signal INST3 to only the source driver 33, the display driver may be arranged so that a switch circuit to selectively enable the direct connection of the final output stage of the source driver 33 to a black-display voltage is controlled, in switching, by the control signal INST3. In order to supply the black-display potential to all the signal electrodes Sig_1 to Sig_n by providing the control signal INST3 to only the gradation-voltage-select circuit 32, the display driver may be arranged so that a switch circuit to selectively enable the direct connection of the final output stage of the gradation-voltage-select circuit 32 to a black-display select level is controlled, in switching, by the control signal INST3. Further, in order to supply the black-display potential to all the signal electrodes Sig_1 to Sig_n by providing the control signal INST3 to only the data latch circuit 31, the display driver may be arranged so that a switch circuit to allow the abnormality-control circuit 18 to input black display data to an input of the data latch circuit 31 is controlled, in switching, by the control signal INST3. The control for the common potential Vcom is not particularly required. FIG. 5 shows an embodiment of the data-cutoff-detection circuit 17. The data-cutoff-detection circuit 17 has: a counter 51 for counting clock signals OSCCLK produced by a built-in oscillator 50, which is arranged so that its count value CNT is initialized by e.g., the synchronizing signal VSYNC (HSYNC); a comparator 54 for comparing the count value CNT of the counter 51 with a threshold DTCT; and a threshold register 52 on which the threshold DTCT is set overwritably. In the case of using the horizontal synchronizing signal HSYNC for reset of the counter 51, a value larger than the count value of the counter 51 in a horizontal display period (i.e. a period between horizontal synchronizing signals HSYNC) is set as the threshold DTCT. In the case of using the vertical synchronizing signal VSYNC for reset of the counter 51, a value larger than the count value of the counter 51 in a vertical display period (i.e. a period between vertical synchronizing signals VSYNC) is set as the threshold DTCT. The output of the comparator 54 is made effective on condition that the video mode is set. In other words, only in the case that the video mode is set on the mode register 53, an output of the comparator 54 is output as a data cutoff flag DFLG from the gate circuit 55 as it is. In the event that the count value of the counter 51 reaches over the threshold DTCT with the video mode set, the data-cutoff-detection circuit 17 detects it as the second state (the data cutoff). That is, no data cutoff is regarded as being caused on condition that CNT<DTCT and DFLG=Low; and data cutoff is regarded as being caused on condition that CNT>DTCT and DFLG=High.

Figure 6:
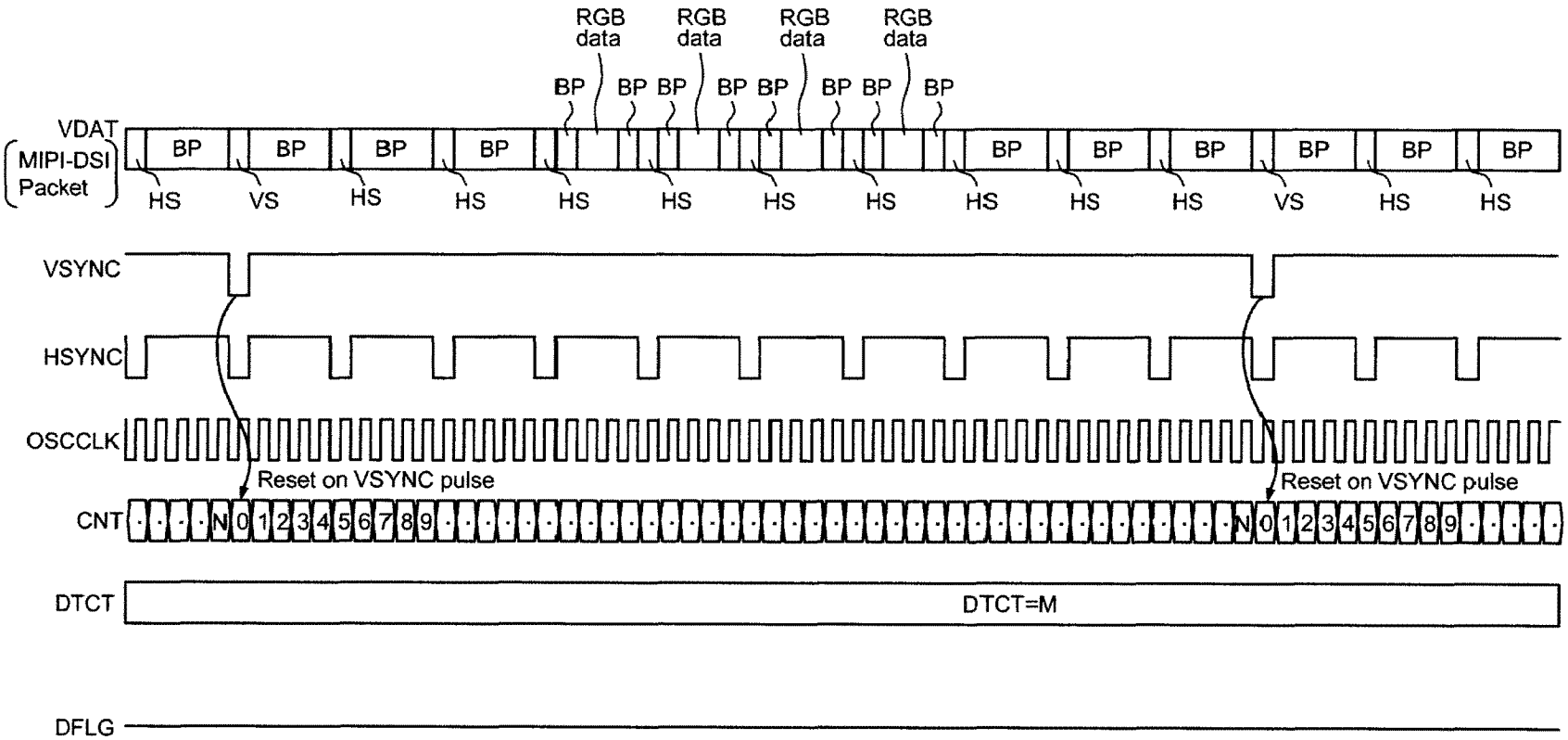
FIG. 6 is a timing chart showing, by example, the timing of the action of the data-cutoff-detection circuit with no data cutoff caused.

As illustrated in FIG. 6, showing, by example, the timing of the action of the data-cutoff-detection circuit 17 with no data cutoff caused, the count value CNT of the counter 51 is reset before reaching the threshold DTCT as long as there is a succession of display data VDAT as represented by MIPI-DSI packets. So, the data cutoff flag DFLG is kept at Low level (in a reset state). In the diagram, BP represents a blanking packet; RGB represents RGB data; HS represents a horizontal synchronization code which is a synchronizing signal equivalent to a horizontal synchronizing signal HSYNC; and VS represents a vertical synchronization code which is a synchronizing signal equivalent to a vertical synchronizing signal VSYNC.

Figure 7:
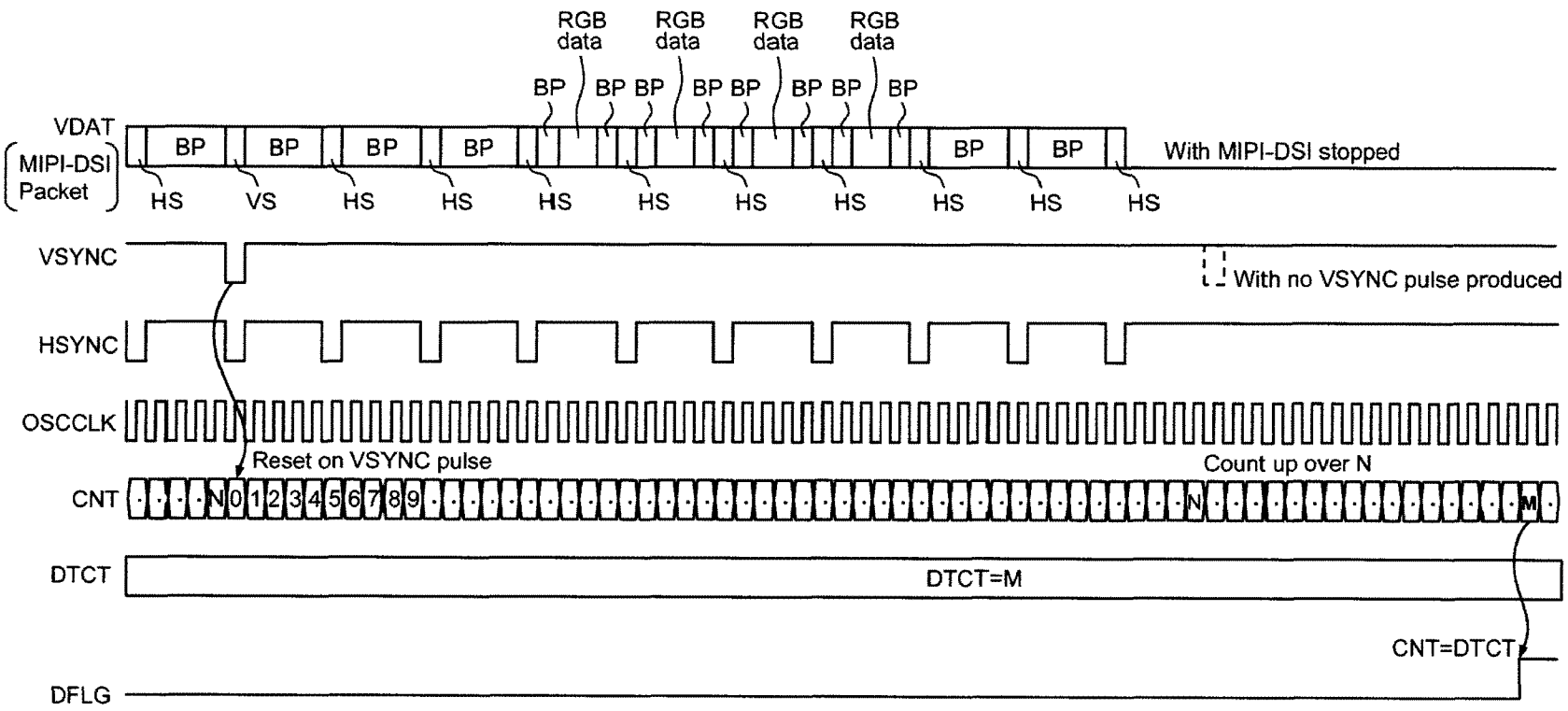
FIG. 7 is a timing chart showing, by example, the timing of the action of the data-cutoff-detection circuit with the data cutoff caused.

On the other hand, in the case of data cutoff taking place, even after the input of display data VDAT as represented by MIPI-DSI packets is cut off in the middle thereof, only the counter 51 keeps counting and thus, the count value CNT exceeds the threshold DTCT, whereby the data cutoff flag DFLG is set at High level, as illustrated in FIG. 7, showing, by example, the timing of the action of the data-cutoff-detection circuit 17.

Figure 8:
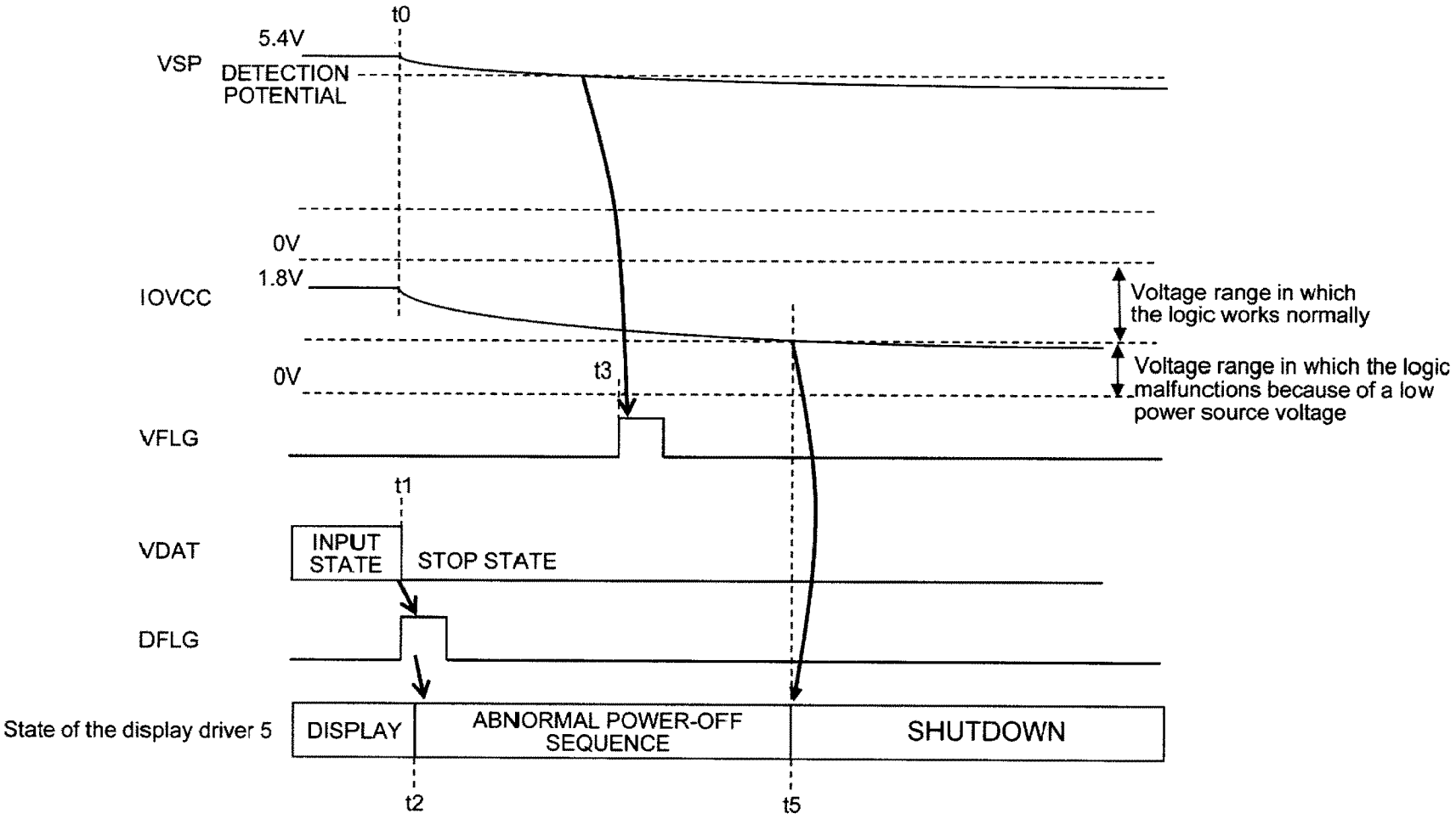
FIG. 8 is a timing chart showing, by example, the timing of the action when having the driving part cope with power source cutoff of the display driver in the event of an undesired power source cutoff (owing to battery fall from a battery power-source part) in a host device or the like located on the side of a higher position of a system.
Figure 9:
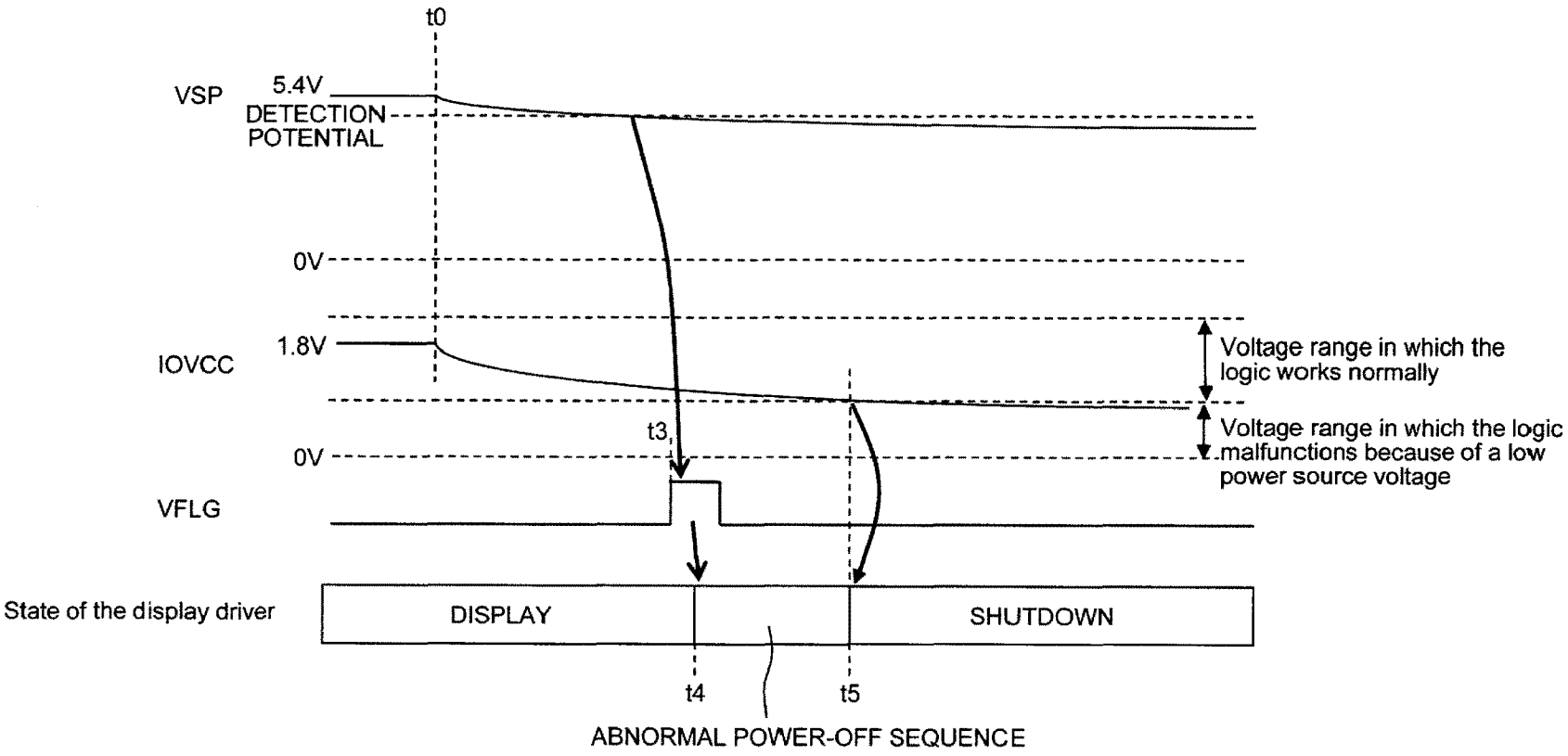
FIG. 9 is a timing chart showing, by example, the action in the case of starting an abnormal power-off sequence from the time t1 when a power-source-cutoff flag VFLG is set.

FIG. 8 shows, by example, the action timing when having the driving part 30 cope with the power source cutoff of the display driver 5 in case that an undesired power source cutoff (a battery fall from the battery power-source part) occurs on a higher-position side of the system, such as the host device 2. The occurrence of an undesired power source cutoff on the higher-position side of the system starts the decrease in voltage of the external power source VSP at the time t0. In case that the external power source VSP reaches a detection potential of the power-source-cutoff-detection circuit 15 or below, the power-source-cutoff flag VFLG is set (at the time t3). Now, it is imagined that between the time t0 and t3, the host device 2 becomes unstable in action and the supply of display data in the video mode is stopped at the time t1. In response to the stop, the data-cutoff-detection circuit 17 sets the data cutoff flag DFLG. After the data cutoff flag DFLG is set in the video mode, the abnormality-control circuit 18 starts an abnormal power-off sequence as the control for having the driving part 30 cope with the power source cutoff of the power source VSP (t2). The time which can be allocated for the abnormal power-off sequence is a length of time given by t5–t2. The time t5 is a point of time when it becomes impossible to keep the external power source IOVCC used as the action power source of the interface part 11 and the logic part 19 at an operation-assurance voltage. After the time t5, the logic part 19 cannot work normally, and the display driver 5 is put in a shutdown state. If the abnormal power-off sequence is started from the time t1 when the power-source-cutoff flag VFLG is set as shown in FIG. 9 by example, its processing time is given by t5–t3, which is remarkably shorter than the time t5–t2 in the embodiment of FIG. 8 and thus, increases the possibility of the display driver 5 being put in the shutdown state before the completion of the abnormal power-off sequence. To achieve the same processing time t5–t2 as that in the embodiment of FIG. 8 by starting the abnormal power-off sequence from the point of time of setting the power-source-cutoff flag VFLG, a processing time of t6–t3 needs to be ensured by externally providing a large stabilization capacitance in a power source route of the external power source IOVCC, thereby slowing down the voltage drop of the external power source IOVCC for logic as shown in FIG. 10, by example.

Figure 10:
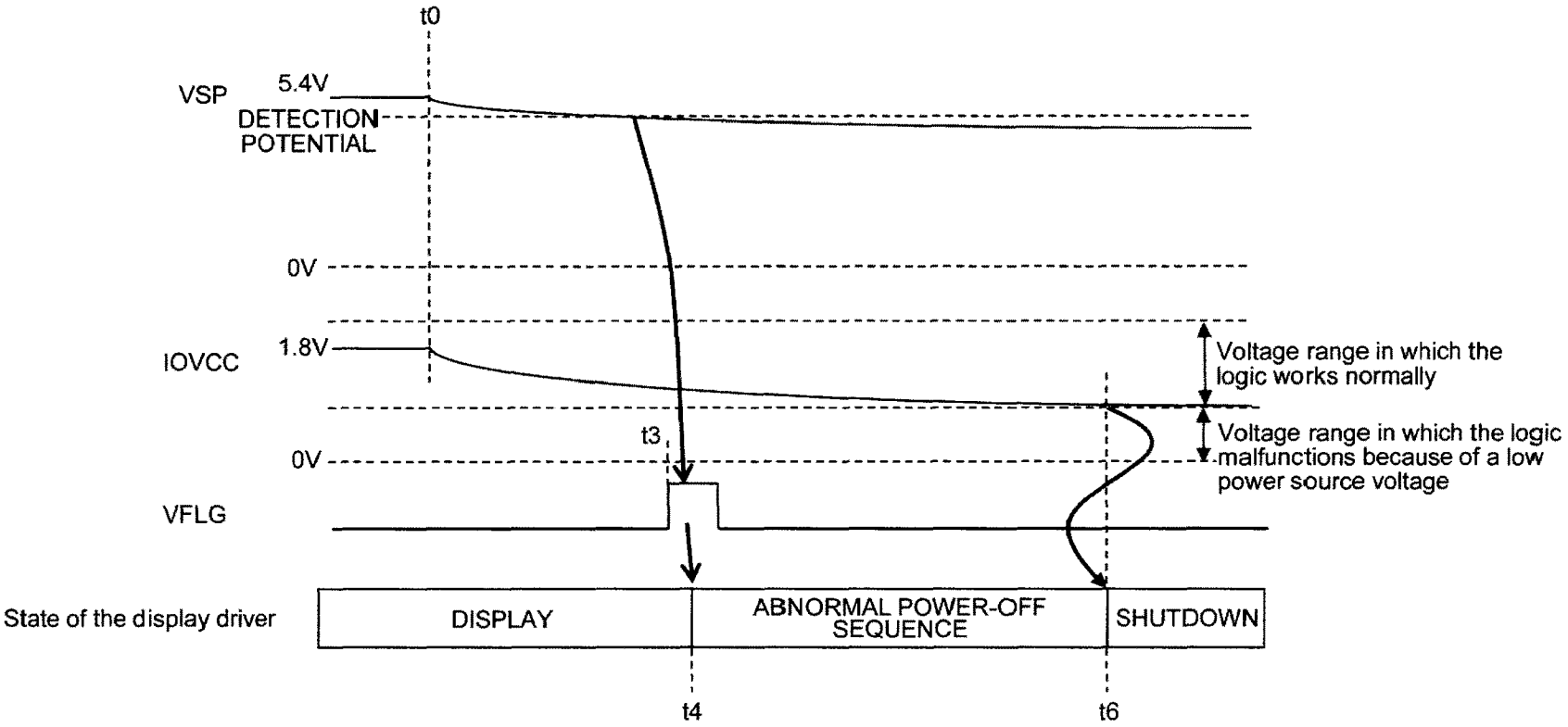
FIG. 10 is a timing chart showing, by example, the action in the case of making arrangement to achieve the same processing time as in the embodiment of FIG. 8, on condition that the abnormal power-off sequence is started from the time when the power-source-cutoff flag VFLG is set.

As is clear from the descriptions presented with reference to FIGS. 8 to 10, it is possible to cope with an undesired power source cutoff based on detection of undesired data cutoff of display data from the host device 2 according to the video mode. That is, not only actually detecting the reduction in voltage of the external power source VSP, but also logically detecting, based on the abnormality, i.e. data cutoff in the condition of interface with the host device 2, the power source cutoff in the host device 2 located on the higher-position side of the system and sharing the battery power-source part, the detection of power source cutoff can be stepped up. This enables the contribution to the system downsizing and the decrease in the burden imposed on users including manufacturers of assembled products without the need for increasing or enlarging an external capacitive element for power source system stabilization.

Figure 11:
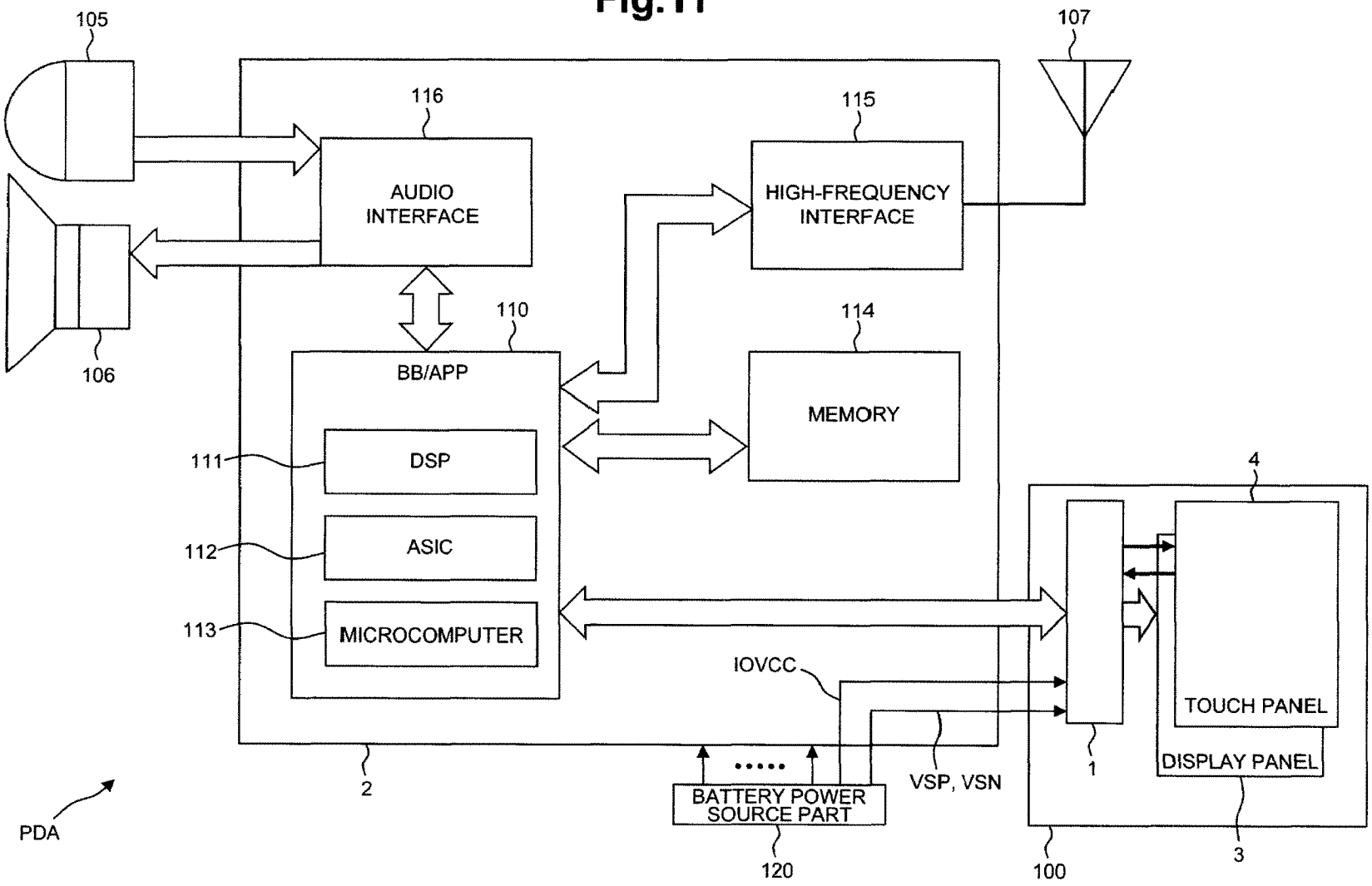

FIG. 11 shows an example of a mobile terminal to which the semiconductor device 1 according to the embodiment of FIG. 3 or 4 is applied, provided that the semiconductor device has a touch panel controller incorporated therein in addition to the display driver 5. The mobile terminal shown in the diagram is a portable telephone, a smart phone or the like, which is an example of a data processing system.

The mobile terminal PDA includes: a display module 100 serving as a display part; an antenna 107 for transmission and reception; a speaker 106 for audio output; a microphone 105 for audio input; and a host device 2. The display module 100 includes: a display panel 3 formed on a glass substrate; a touch panel 4 formed thereon; and a semiconductor device 1 mounted on the resultant glass substrate. Although no special restriction is intended, the host device 2 has an audio interface 116 for performing signal input/output on the speaker 106 and the microphone 105, a high-frequency interface 115 for performing signal input to and output from the antenna 107, a memory 114, and a base-band/application processor part (BB/APP) 110 for controlling a communication protocol process and other application processes. Although no special restriction is intended, BB/APP 110 has DSP (Digital Signal Processor) 111 which performs signal processes in connection with audio signals and transmission and reception signals, ASIC (Application Specific Integrated Circuits) 112 which provides a custom function (user logic) , and a microprocessor or microcomputer (hereinafter abbreviated as "MICON") 113 serving as a data processing unit which controls the whole device.

Although no special restriction is intended, the mobile terminal PDA has a battery power-source part 120 as a system power source. The battery power-source part 120 has a battery, of which the graphic representation is omitted. The battery power-source part 120 supplies power sources VSP, VSN and IOVCC to the semiconductor device 1 having the display driver 5 and in addition, provides an action power source to the host device 2. The host device 2 is larger than the semiconductor device 1 in power consumption. Therefore, in the event of battery fall from the battery power-source part 120, the power source cutoff in the host device 2 is considered to occur earlier than that in the semiconductor device 1 in many cases. In other words, in comparison to the time until the voltages of the power sources VSP, VSN and IOVCC lower to an operation-assurance voltage or below is shorter than the time until the action power source of the host device 2 lowers to its operation-assurance voltage or below. In such a case, the data cutoff flag DFLG is set with a time earlier than the time when the power-source-cutoff flag VFLG is set as described with reference to FIG. 8. Therefore, even if the battery falls out during the time when the host device 2 supplies display data to the display driver 5 in the video mode and displays on the display panel 3, the abnormal power-off sequence can be completed before the power-source-cutoff flag VFLG is set; and the display driver 5 can have enough time to finish the abnormal power-off sequence. This enables the contribution to the downsizing of a mobile terminal PDA and the decrease in the burden imposed on users including manufacturers of assembled products without the need for increasing or enlarging an external capacitive element for stabilization of power source system for the display driver 5.

While the invention made by the inventor has been concretely described based on the embodiments thereof, the invention is not limited to the embodiments. It is obvious that various changes and modifications may be made without departing from the subject matter thereof.

For instance, the display panel targeted for display driving by a display driver which is one embodiment of the semiconductor device according to the invention is not limited to a liquid crystal display panel, which may be a display panel of another type such as an electroluminescence panel. A driven circuit to be driven by the semiconductor device according to the invention is not limited to a display panel, which may be e.g., a device such as a spindle of a motor or the like, which needs stopping at its start position when being stopped, or another circuit device of which the circuit condition when it is stopped needs to be turned back to its initial one.

The methods for detecting the first state of power source cutoff, and the second state of data cutoff are not limited to the above embodiments, and various changes and modifications may be made appropriately. For instance, the detection of the first state is not limited to the detection of a voltage, which may be the detection of electric current. In addition, the target for detection of the first state is not limited to an external power source used as a driving power source of a driving part, which may be an external power source used as an action power source of the logic part, or both of them.

The stream data accompanied by synchronizing signals and targeted for the detection of the second state of data cutoff are not limited to display data of the video mode. The synchronizing signals are not limited to display timing signals such as VSYNC and HSYNC, which may be e.g., particular identification packets to be disposed at e.g., respective packet heads of successions of data packets.

We claim:

1. A semiconductor device comprising:

an interface circuit operable to receive a data stream and at least one synchronization signal:

a logic circuit operable to process the received data stream, wherein the logic circuit comprises a data cutoff detection circuit operable to detect an interruption to the synchronization signal, wherein the data cutoff detection circuit comprises:

a counter operable to reset a count value responsive to the synchronization signal, and to increment the count value responsive to count cycles of a clock signal;

a register comprising a threshold value; and a comparator operable to compare the count value and the threshold value, wherein the data cutoff detection circuit detects the interruption to the synchronization signal when the count value exceeds the threshold value;

a driver circuit operable to generate drive signals responsive to the processed data stream; and a control circuit operable to generate at least one control signal for the driver circuit responsive to the interruption to the synchronization signal; and wherein the synchronization signal is a horizontal or vertical synchronization signal.

2. The semiconductor device according to claim 1, wherein the data stream comprises display data, wherein the at least one synchronization signal comprises a plurality of display timing signals, and wherein the drive signals are configured to drive a display panel.

3. The semiconductor device according to claim 2, wherein the data cutoff detection circuit is configured to detect the interruption based on the presence or absence of a predetermined display timing signal of the plurality of display timing signals.

4. The semiconductor device according to claim 2, wherein the driver circuit is configured to, responsive to the control signal, initialize charge information remaining on pixels of the display panel.

5. The semiconductor device according to claim 2, wherein the logic circuit and the driver circuit are configured to, responsive to the control signal, uniformly drive pixels of the display panel.

6. The semiconductor device according to claim 1, further comprising:

a power source circuit operable to provide at least one internal power source responsive to receiving at least one external power source, wherein the power source circuit comprises a power source cutoff detection circuit operable to detect an interruption to the external power source, and wherein the control signal generated by the control circuit is further responsive to the interruption to the external power source.

7. The semiconductor device according to claim 6, wherein the at least one external power source comprises a first external power source having a first voltage, and a second external power source having a second voltage less than the first voltage, wherein the at least one internal power source comprises a first internal power source produced from the first external power source, and a second internal power source produced from the second external power source, wherein the power source cutoff detection circuit is configured to detect the interruption to the external power source using the first external power source, wherein each of the interface circuit and the logic circuit use the second internal power source, and wherein the driver circuit uses the first internal power source.

8. The semiconductor device according to claim 1, wherein the interface circuit is operable in a selected mode of:

a first interface mode in which the data stream is received synchronously with the at least one synchronization signal; and a second interface mode in which the data stream is received asynchronously with the at least one synchronization signal, and wherein the interruption is detected when the interface circuit is operating in the first interface mode.

9. The semiconductor device according to claim 4, wherein the at least one control signal comprises:

a first control signal for a gate control driver of the driver circuit, wherein the first control signal causes the gate control driver to select all of a plurality of scan electrodes of the display panel; and a second control signal for a source driver of the driver circuit, wherein the second control signal causes the source driver to supply a ground potential to all of a plurality of signal electrodes of the display panel.

10. A mobile terminal comprising:

a host device;

a driving device operably controlled by the host device, wherein the driving device comprises:

an interface circuit operable to receive a data stream and at least one synchronization signal from the host device;

a logic circuit operable to process the received data stream, wherein the logic circuit comprises a data cutoff detection circuit operable to detect an interruption to the synchronization signal, wherein the data cutoff detection circuit comprises:

a counter operable to reset a count value responsive to the synchronization signal, and to increment the count value responsive to count cycles of a clock signal;

a register comprising a threshold value; and a comparator operable to compare the count value and the threshold value, wherein the data cutoff detection circuit detects the interruption to the synchronization signal when the count value exceeds the threshold value;

a driver circuit operable to generate drive signals responsive to the processed data stream; and a control circuit operable to generate at least one control signal for the driver circuit responsive to the interruption to the synchronization signal;

a driven device responsive to the drive signals driven by the driving device; and wherein the synchronization signal is a horizontal or vertical synchronization signal.

11. The mobile terminal according to claim 10, wherein the data stream comprises display data, wherein the at least one synchronization signal comprises a plurality of display timing signals, and wherein the driven device comprises a display panel.

12. The mobile terminal according to claim 11, wherein the data cutoff detection circuit is operable to detect the interruption based on the presence or absence of the horizontal synchronization signal of the plurality of display timing signals.

13. The mobile terminal according to claim 11, wherein the data cutoff detection circuit is operable to detect the interruption based on the presence or absence of the vertical synchronization signal of the plurality of display timing signals.

14. The mobile terminal according to claim 11, wherein the driver circuit is configured to, responsive to the control signal, initialize charge information remaining on pixels of the display panel.

15. The mobile terminal according to claim 11, wherein the logic circuit and the driver circuit are configured to, responsive to the control signal, uniformly drive pixels of the display panel.

16. The semiconductor device according to claim 5, wherein the at least one control signal comprises:

a first control signal for a gate control driver of the driver circuit, wherein the first control signal causes the gate control driver to select all of a plurality of scan electrodes of the display panel, wherein the control circuit is further operable to generate a second control signal for a data latch circuit of the logic circuit, wherein the second control signal causes black data to be provided to a source driver of the driver circuit.

17. The mobile terminal according to claim 10, further comprising:

a battery; and a power source circuit operable to provide at least one internal power source responsive to receiving at least one external power source from the battery, wherein the power source circuit comprises a power source cutoff detection circuit operable to detect an interruption to the external power source, and wherein the control signal generated by the control circuit is further responsive to the interruption to the external power source.

18. The mobile terminal according to claim 10, wherein the interface circuit is operable in a selected mode of:

a first interface mode in which the data stream is received synchronously with the at least one synchronization signal; and a second interface mode in which the data stream is received asynchronously with the at least one synchronization signal, and wherein the interruption is detected when the interface circuit is operating in the first interface mode.

* * * * *